US006823803B2

(12) United States Patent
Preisler

(10) Patent No.: US 6,823,803 B2
(45) Date of Patent: Nov. 30, 2004

(54) ASSEMBLY FOR ENCLOSING AND PROTECTING A PLURALITY OF METERS FOR STORAGE OR TRANSPORTATION PURPOSES AND CARRIER AND PALLET FOR USE THEREIN

(75) Inventor: Darius J. Preisler, Macomb, MI (US)

(73) Assignee: Patent Holding Company, Fraser, MI (US)

( * ) Notice: Subject to any disclaimer, the term of this patent is extended or adjusted under 35 U.S.C. 154(b) by 160 days.

(21) Appl. No.: 10/197,766

(22) Filed: Jul. 17, 2002

(65) Prior Publication Data

US 2003/0082366 A1 May 1, 2003

Related U.S. Application Data

(63) Continuation-in-part of application No. 10/016,081, filed on Oct. 30, 2001, now Pat. No. 6,655,299.

(51) Int. Cl.[7] ..... B65D 19/00
(52) U.S. Cl. ..... 108/51.3
(58) Field of Search ..... 108/51.3, 51.11, 108/57.25, 57.27, 57.34, 901, 902; 206/303, 335, 701, 386, 598, 595

(56) References Cited

U.S. PATENT DOCUMENTS

| | | | | |
|---|---|---|---|---|
| 4,653,651 A | * | 3/1987 | Flum | 108/55.3 |
| 4,937,125 A | | 6/1990 | Sammartin et al. | |
| 5,029,734 A | * | 7/1991 | Nichols | 108/55.3 |
| 5,205,221 A | * | 4/1993 | Melin et al. | 108/51.3 |
| 5,337,681 A | | 8/1994 | Schrage | |
| 5,365,859 A | | 11/1994 | Schrage | |
| 5,497,709 A | | 3/1996 | Gonzalez et al. | |
| 5,503,271 A | * | 4/1996 | Lynch | 206/305 |
| 5,596,933 A | | 1/1997 | Knight et al. | |
| 5,647,284 A | * | 7/1997 | Frysinger et al. | 108/55.1 |

(List continued on next page.)

FOREIGN PATENT DOCUMENTS

| | | |
|---|---|---|
| EP | 0 473 422 A1 | 3/1992 |
| EP | 0 551 776 A1 | 7/1993 |
| EP | 0 649 736 A1 | 4/1995 |
| EP | 0 783 959 A2 | 7/1997 |
| FR | 79 23257 | 4/1980 |
| FR | 2711573 | 5/1995 |
| WO | WO 88/03086 | 5/1988 |

*Primary Examiner*—Jose V. Chen
(74) *Attorney, Agent, or Firm*—Brooks Kushman, P.C.

(57) ABSTRACT

An assembly for enclosing and protecting a plurality of meters for storage or transportation purposes and carrier and pallet for use therein are provided. The assembly includes a plurality of carriers. Each of the carriers includes a base unit having upper and lower surfaces for receiving and retaining a plurality of meters in a predetermined spaced relationship thereon and a cover unit movable between a closed position for enclosing, protecting and immobilizing the meters within the base unit and an open position to allow storage or retrieval of one or more meters to or from the base unit, respectively. The assembly also includes a pallet having a load-bearing, upper surface and a tine-engaging, lower surface and an array of apertures extending between the load-bearing, upper surface and tine-engaging, lower surface for receiving and retaining lower portions of the meters in the predetermined spaced relationship thereon when the carriers are supported on the load-bearing, upper surface of the pallet.

20 Claims, 3 Drawing Sheets

U.S. PATENT DOCUMENTS 5,673,630 A 10/1997 Schutz
5,683,782 A 11/1997 Duchene
5,687,652 A 11/1997 Ruma
5,704,476 A * 1/1998 Abbott ..... 206/386
5,720,229 A 2/1998 Schrage
5,755,162 A 5/1998 Knight et al.
5,791,262 A 8/1998 Knight et al.
5,806,436 A 9/1998 Weichenrieder
5,865,315 A 2/1999 Uitz
5,868,080 A 2/1999 Wyler et al.
5,888,610 A 3/1999 Fournier et al.
5,891,560 A 4/1999 Edwards et al.
5,921,189 A 7/1999 Estepp
5,937,767 A 8/1999 Togawa et al.
5,950,546 A 9/1999 Brown et al.
6,006,677 A 12/1999 Apps et al.
6,050,630 A 4/2000 Hochet
6,125,770 A 10/2000 Brandenburg
6,155,181 A 12/2000 Chilcutt
6,165,604 A 12/2000 Edwards et al.
6,173,657 B1 1/2001 Espejo
6,180,203 B1 1/2001 Unkles
6,187,411 B1 2/2001 Palmer
6,199,488 B1 3/2001 Favaron et al.
6,216,608 B1 4/2001 Woods et al.
6,655,299 B2 * 12/2003 Preisler et al. ..... 108/51.3

* cited by examiner

ASSEMBLY FOR ENCLOSING AND PROTECTING A PLURALITY OF METERS FOR STORAGE OR TRANSPORTATION PURPOSES AND CARRIER AND PALLET FOR USE THEREIN

CROSS-REFERENCE TO RELATED APPLICATION

This application is a continuation-in-part application of U.S. patent application entitled "A Reinforced Composite Pallet Assembly of the Cellular Core Sandwich-Type" filed Oct. 30, 2001 and having U.S. Ser. No. 10/016,081 now U.S. Pat. No. 6,655,299.

BACKGROUND OF THE INVENTION

1. Field of the Invention

This invention relates to assemblies for enclosing and protecting a plurality of meters for storage or transportation purposes and carriers and pallets for use therein.

2. Background Art

It is desirable to protect meters such as utility meters while they are being stored or transported. Such meters may be new, used or reconditioned. It is further desirable to hold the meter in place while offering protection for safer shipping, handling and storing such meters.

U.S. Pat. No. 5,503,271 discloses an electric meter case for enclosing and protecting a single electric meter. However, the prior art fails to provide apparatus or assemblies for enclosing and protecting a plurality of meters for storing or transportation purposes. Since a typical electrical utility meter weighs approximately 4–6 lbs., such an assembly or apparatus should be capable of enclosing and protecting a load that can quickly add up.

Sandwich-type materials having cellular cores have very important characteristics resulting from their being light in weight yet very rigid.

Conventionally, such a panel is constructed by sandwiching a cellular core having low strength characteristics by gluing it or bonding it between two skins, each of which is much thinner than the cellular core but has excellent mechanical characteristics.

The patent document FR 2 711 573 discloses a method of making a panel of sandwich-type composite structure having a cellular core. In that method, said panel is made in a single step by subjecting a stack to cold-pressing in a mold, which stack is made up of at least a first skin made of a stampable reinforced thermoplastics material, of a cellular core made of a thermoplastics material, of a second skin made of a stampable reinforced thermoplastics material, and of a first external covering layer made of a woven or non-woven material, the skins being preheated outside the mold to a softening temperature.

Such a method is particularly advantageous because of the fact that it makes it possible, in a single operation, both to generate cohesion between the various layers of the composite structure, and to shape the panel.

The resulting panel conserves all of the mechanical properties imparted by the cellular core sandwich structure.

European patent EP 0 649 736 B1 explains the principle of molding substantially flat parts out of thermoplastic sandwich material (TSM). The part is made in a single stage by pressing in a cold mold, at a pressure in the range of 10 bars to 30 bars, a stack consisting of at least a first top skin layer of stampable reinforced thermoplastics material, a cellular or honeycomb core of thermoplastics material and a second bottom skin layer of stampable reinforced thermoplastics material. The axes of the cells of the cellular core are generally oriented perpendicular to the skin layers. The skin layers and core are previously heated outside the mold to a softening temperature. Such sandwich material is also described in U.S. Pat. No. 5,683,782. The cellular core of such material enables the part to be very rigid while being light in weight.

U.S. Pat. No. 6,050,630 discloses a molded composite stack including a cellular core for a vehicle and a mold for forming the stack into a vehicular part, such as a floor panel.

Panels of sandwich-type composite structures having a cellular core have strength characteristics sufficient to enable mechanical structures subjected to large stresses to be reinforced structurally without making them too heavy. Such panels are in common use in shipbuilding, aircraft construction, and rail vehicle construction.

However, the non-uniformness of the mechanical stresses to which they are subjected sometimes makes it necessary to form local reinforcing plies at those places in said panels where the mechanical stresses are greatest.

In the field of aircraft construction, sandwich structure composite panels are made that are based on thermosettable resins reinforced with glass fibers.

In order to impart the desired shapes to the panels, and to maintain the shapes, the glass fibers and the thermosettable resin (in the form of pre-impregnates) are deposited layer-by-layer in a mold, and are then heated to high temperatures so as to cure (i.e. polymerize) the resin permanently.

The molds used may have a punch or a die, or else both a punch and a die.

Making such locally-reinforced panels consists firstly in defining zones where stresses are concentrated in the resulting panels, such zones being defined either by real testing or by computer simulation, and then in adding reinforcing plies at those places so as to make it possible to withstand such stresses.

The reinforcing plies are one-directional mats or woven fabrics of glass fibers, of carbon fibers, or of natural fibers embedded in a thermosettable resin, with an orientation that is determined by the orientation of the stresses. They are cut out to a pattern using special machines, e.g. water-jet cutting machines.

The reinforcing plies are disposed layer-by-layer in a mold, either manually or by means of a robot, with each ply having its own orientation.

That operation may be referred to as the "laying up" operation.

Then comes the baking step which is the longest step of the method of making such pieces because the stack of layers must be heated sufficiently to cure the thermosettable resin.

The various layers disposed in the mold are pressed in the mold by evacuating the mold. Such evacuation serves to press the materials against the die or the punch, and to remove surplus resin.

The desired shape is thus obtained with the fibers being impregnated with the resin as well as possible.

That "lamination" technique, and in particular the "laying up" operation, is characterized by a very low level of automation, and a large labor input.

Although, by means of the concept of localizing the strength, that technique makes it possible to achieve performance levels that are high for the pieces that are made in that way, it requires rigorous monitoring of quality.

As a result, that technique is very costly and cannot be used at the high production throughputs implemented in many fields such as the automobile industry.

Generally, plastic pallets can be easily molded and are lighter in weight than wooden pallets. Furthermore, in general, plastic pallets are more durable than wooden pallets as shown in U.S. Pat. No. 5,497,709.

Plastics processing technology has enjoyed significant recent advances, such that traditional high-strength materials such as metals are being replaced with fiber composite materials. These materials are not only light, but also are flexible and durable.

U.S. Pat. Nos. 5,891,560 and 6,165,604 disclose fiber-reinforced composites prepared from a depolymerizable and repolymerizable polymer having the processing advantages of a thermoset without being brittle. Impregnation of polymer into the fiber bundle is achieved, while still producing a composite with desirable physical properties and high damage tolerance.

One factor that has limited the number of plastic pallets is that plastic pallets require a given amount of relatively expensive plastic material for a desired measure of pallet strength. U.S. Pat. Nos. 5,868,080 and 6,199,488 disclose reinforced plastic pallet constructions and assembly methods wherein multiple reinforcing bars are employed. The reinforcing bars preferably comprise composite structural members of fiberglass reinforced thermosetting plastic fabricated from a pultrusion process.

As noted in the above-mentioned '560 and '604 patents, although thermoset composites have excellent mechanical properties, they suffer from several disadvantages: thermoset matrices have relatively limited elongation, the thermoset precursors are a source of undesirable volatile organic compounds (VOCs), the composites cannot be reshaped or recycled, and their production rates are limited.

Consequently, in principle at least, thermoplastic composites would solve many of the problems associated with thermosets. For example, unlike thermosets, thermoplastics can be reshaped, welded, staked, or thermoformed. Furthermore, thermoplastics are generally tougher, more ductile, and have greater elongation than thermosets.

SUMMARY OF THE INVENTION

An object of the present invention is to provide an assembly for enclosing and protecting a plurality of meters for storage or transportation purposes and carrier and pallet for use therein.

In carrying out the above object and other objects of the present invention, an assembly for enclosing and protecting a plurality of meters for storage or transportation purposes is provided. The assembly includes a plurality of carriers. Each of the carriers includes a base unit having upper and lower surfaces for receiving and retaining a plurality of meters in a predetermined spaced relationship thereon and a cover unit movable between a closed position for enclosing, protecting and immobilizing the meters within the base unit and an open position to allow storage or retrieval of one or more meters to or from the base unit, respectively. The assembly also includes a pallet having a load-bearing, upper surface and a tine-engaging, lower surface and an array of apertures extending between the load-bearing, upper surface and tine-engaging, lower surface for receiving and retaining lower portions of the meters in the predetermined spaced relationship thereon when the carriers are supported on the load-bearing, upper surface of the pallet.

The base unit may be a composite base unit of the sandwich-type having a cellular core.

The cover unit may be a composite cover unit of the sandwich-type having a cellular core, and the base and cover units may have a common skin of reinforced thermoplastics material.

The assembly may further include a hinge for hingedly connecting the cover unit to the base unit wherein a portion of the common skin forms the hinge.

The base unit may include an array of holes extending between the upper and lower surfaces of the base unit, and the meters may be received and retained within the holes so that lower portions of the meters are suspended below the lower surface of the base unit.

The array of holes and the array of apertures may be aligned when the carriers are supported on the load-bearing, upper surface of the pallet.

The pallet may be of the sandwich-type having a cellular core.

The assembly may further include a plurality of spaced, holding devices extending upwardly from the load-bearing, upper surface for holding the plurality of carriers on the load-bearing, upper surface.

The meters may be utility meters, such as electric utility meters.

Further in carrying out the above object and other objects of the present invention, a carrier for carrying a plurality of meters therein is provided. The carrier includes a base unit having upper and lower surfaces for receiving and retaining a plurality of meters in a predetermined spaced relationship thereon. A cover unit is connected to the base unit so as to be movable between a closed position for enclosing, protecting and immobilizing the meters within the base unit and an open position to allow storage or retrieval of one or more meters to or from the base unit, respectively. A mechanism is provided for alternatively fastening or unfastening the cover unit to or from the base unit, respectively.

The base unit may be a composite base unit of the sandwich-type having a cellular core.

The cover unit may be a composite cover unit of the sandwich-type having a cellular core, and the base and cover units may have a common skin of reinforced thermoplastics material.

The carrier may further include a hinge for hingedly connecting the cover unit to the base unit wherein a portion of the common skin forms the hinge.

One of the base unit and the cover unit may provide an integrally-formed carrying handle.

The base unit may include an array of holes extending between the upper and lower surfaces. The meters may be received and retained within the holes so that lower portions of the meters are suspended below the lower surface of the base unit.

Still further in carrying out the above object and other objects of the present invention, a pallet of the sandwich-type having a cellular core is provided. The pallet includes a substantially flat deck having upper and lower surfaces and front, back and side edges and includes: a) a load-bearing skin made of reinforced thermoplastics material; b) at least one grid of reinforcing slats; c) a cellular core made of a thermoplastics material; and d) a tine-engaging skin made of a reinforced thermoplastics material, the at least one grid of reinforcing slats being positioned at predetermined places against at least one skin. At least one support supports the deck so that tines can lift and support the pallet at the tine-engaging skin. The deck further includes an array of apertures extending between the upper and lower surfaces and configured to receive and retain lower portions of the meters in a predetermined spaced relationship therein.

The pallet may further include a plurality of spaced, holding devices extending upwardly from the upper surface of the deck for holding a plurality of meter-carrying carriers supported on the upper surface of the deck.

The pallet may be nestable.

The deck may include upper and lower grids of reinforcing slats positioned symmetrically with respect to a plane formed by the cellular core at predetermined places against the skins and at the cellular core.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
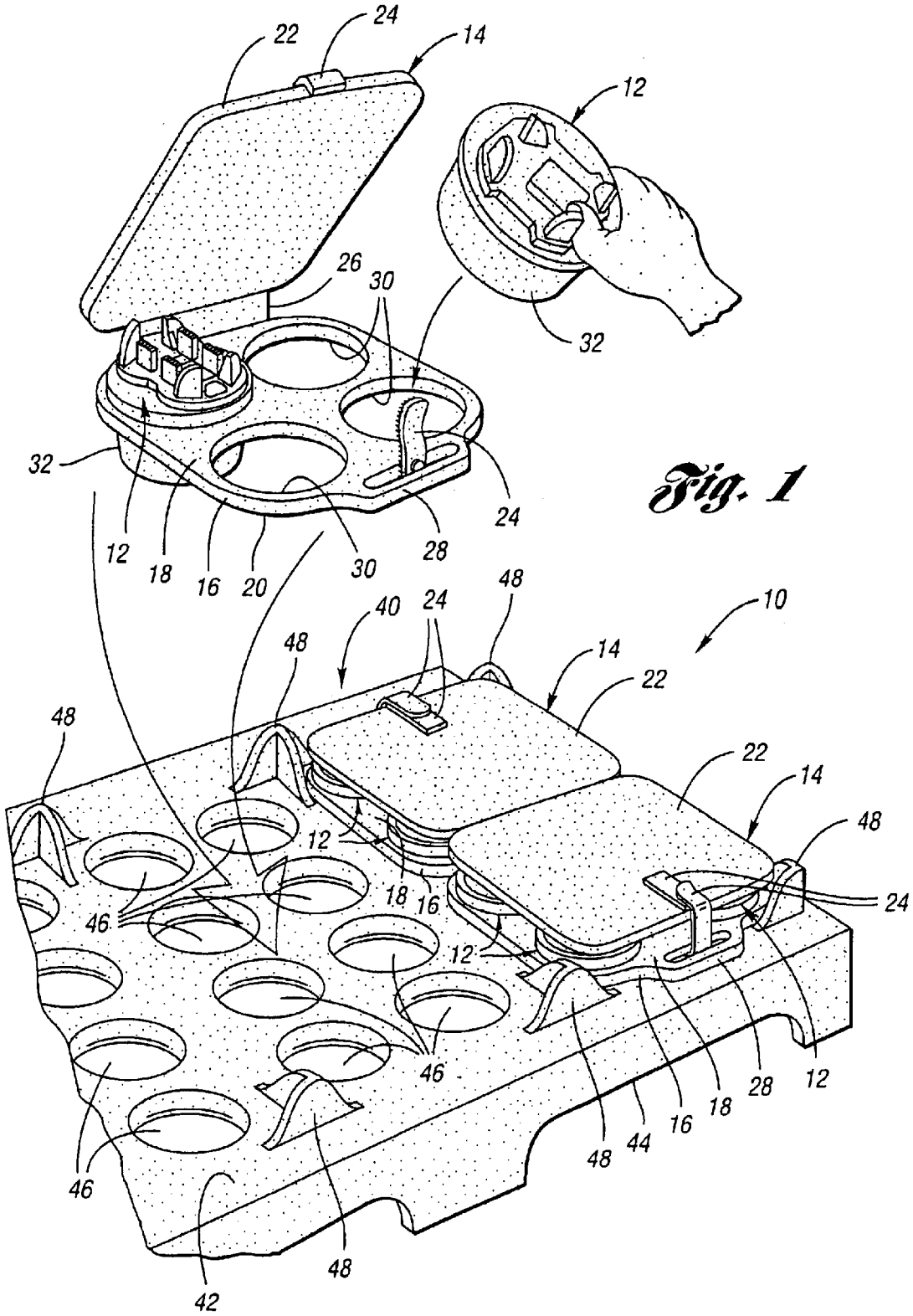
FIG. 1 is an exploded perspective view of an assembly for enclosing and protecting a plurality of meters for storage or transportation purposes and carrier and pallet for use therein.

Referring now to the drawing Figures, there is illustrated in FIG. 1 an assembly, generally indicated at 10, for enclosing and protecting a plurality of meters, generally indicated at 12, for storage or transportation purposes. The assembly 10 includes a plurality of carriers, generally indicated at 14. Each of the carriers 14 including a base unit 16 having upper and lower surfaces 18 and 20, respectively, for receiving and retaining a plurality of the meters 12 in a predetermined spaced relationship thereon. Each of the carriers 14 also includes a cover unit 22 movable between a closed position for enclosing, protecting and immobilizing the meters 12 within the base unit 16 and an open position to allow storage or retrieval of one or more meters 12 to or from the base unit 16, respectively.

A mechanism 24 in the form of a nylon material made with both a surface of tiny hooks and a complementary surface of a clinging pile (i.e. such as Velcro) is provided for alternatively fastening or unfastening the cover unit 22 to or from the base unit 16, respectively.

The base unit 16 is preferably a composite base unit of the sandwich-type having a cellular core. The cover unit 22 is also preferably a composite cover unit of the sandwich-type having a cellular core. The base and cover units 16 and 22, respectively, have a connector preferably provided by common skin of reinforced thermoplastics material which forms a hinge 26 for hingedly connecting the cover unit 22 to the base unit 16 wherein a portion of the common skin forms the hinge 26.

One of the base unit 16 and the cover unit 22 provides an integrally-formed carrying handle 28. In FIG. 1, the base unit 16 provides the handle 28.

The base unit 16 includes an array of holes 30 which extend between the upper and lower surfaces 18 and 20, respectively. The holes 30 are preferably punched through the base unit 16. The meters 12 are received and retained within the holes 30 so that lower portions 32 of the meters 12 are suspended below the lower surface 20 of the base unit 16.

As also shown in FIG. 1, the assembly 10 also includes a pallet, generally indicated at 40, of the sandwich-type having a cellular core. The pallet 40 has a load-bearing, upper surface 42 and a tine-engaging, lower surface 44 and an array of apertures 46 extending between the load-bearing, upper surface 42 and tine-engaging, lower surface 44 for receiving and retaining the lower portions 32 of the meters 12 in the predetermined spaced relationship thereon when the carriers 14 are supported on the load-bearing, upper surface 42 of the pallet 40. The apertures 46 are also preferably punched through the pallet 40.

Figure 2:
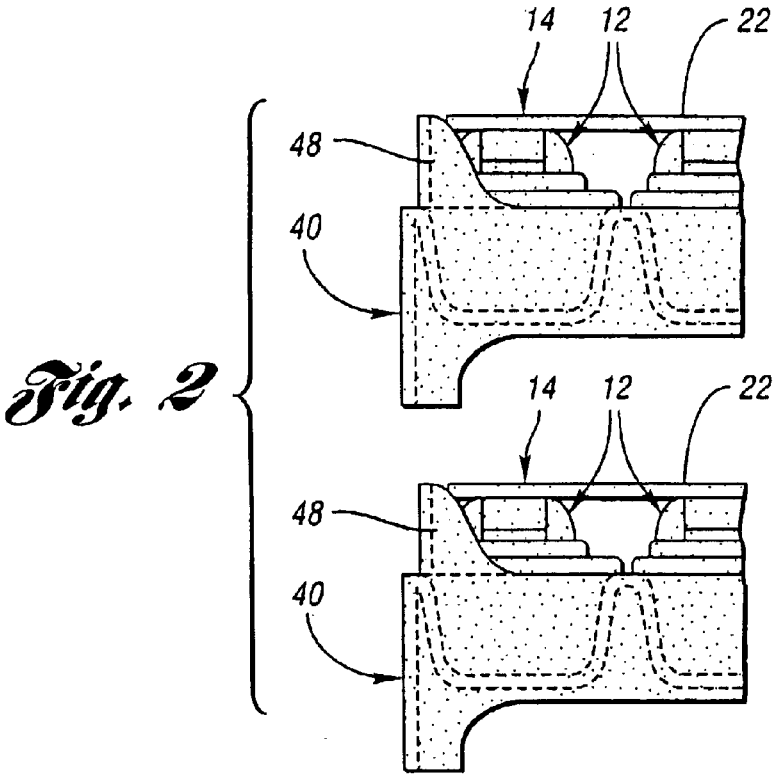
FIG. 2 is a side elevational view, partially broken away, of two nestable pallets of the present invention.

As shown in FIG. 2, the pallets 40 are preferably "nestable" to allow easy stacking of multiple assemblies 10.

The array of holes 30 and the array of apertures 46 are aligned when the carriers 14 are supported on the load-bearing, upper surface 42 of the pallet 40.

A plurality of spaced, plastic holding devices 48 extend upwardly from the load-bearing, upper surface 42 for holding the plurality of carriers 14 on the load-bearing, upper surface 42.

The meters 12 may be utility meters such as electric, gas or water utility meters.

Figure 3:
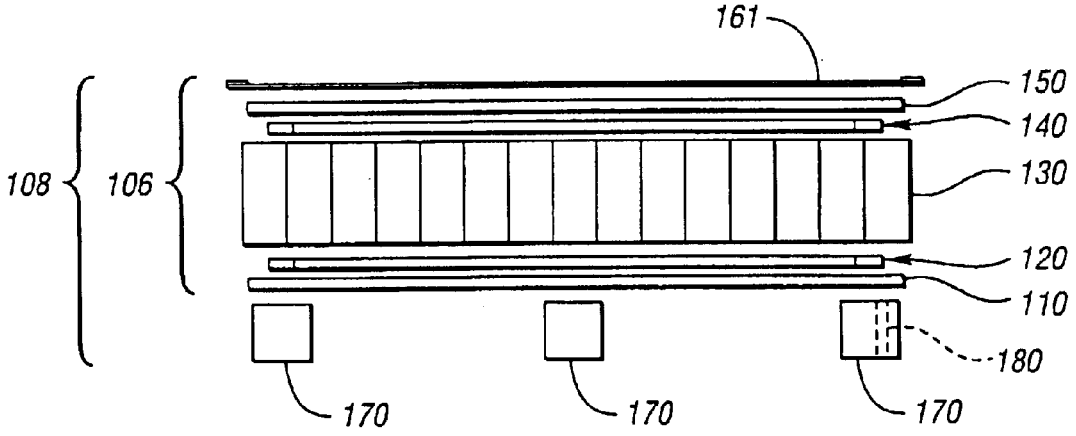
FIG. 3 is a side schematic view of a stack of layers of a deck of another pallet of the present invention and supports thereof wherein the layers and supports are shown vertically spaced from each other for clarity.

FIG. 3 shows a stack formed during a first step of a method of making a reinforced composite pallet assembly of the cellular core sandwich-type of the present invention. The first step involves making a flat deck, indicated at 106 in FIG. 3. One of the flat decks 106 is used in the embodiment of a pallet assembly (i.e. generally indicated at 108 in FIG. 4).

In this example, the stack is made up successively of: a tine-engaging skin 110 made of a reinforced thermoplastics material; a lower grid of reinforcing slats 120 each of which may be made of a reinforced thermoplastic composite or pultrusion; a cellular core 130 made of thermoplastics material; an upper grid of reinforcing slats, generally indicated at 140, each of which may be made of a reinforced thermoplastic composite or pultrusion; and a load-bearing skin 150 made of a reinforced thermoplastic material. Alternatively, the slats may be made of other types of pultrusions or other materials such as metal.

In addition, the stack may include an outer covering layer 161 made of a woven or non-woven material such as foil disposed on the second skin 150. The outer covering layer 161 may be made of felt or of carpeting such as polypropylene carpeting.

Each of the first and second grids of reinforcing slats 120 and 140, respectively, has a surface area smaller than the surface area of each of the first and second skins 110 and 150, respectively. The first and second grids of reinforcing slats 120 and 140, respectively, are positioned symmetrically about the plane formed by the cellular core 130 at determined places against the skins 110 and 150, respectively. More particularly, the grids of slats 120 and 140 are positioned at those predetermined places of the pallet assembly 108 which are to be subjected to the greatest mechanical stresses caused by the load which is supported by the assembly 108.

The pallet assembly 108 also includes at least one support and, preferably, nine spaced apart, hollow thermoplastic supports or feet 170 for supporting the deck 106 so that tines of a fork lift vehicle can lift and support the pallet 108 at the inner surface of the tine-engaging skin 110.

An identification device 180 in the form of a microchip or an RF identification card may be positioned within one of the hollow feet 170 to allow the pallet 108 and its goods to be quickly and simply identified.

Each of the first and second skins 110 and 150, respectively, is advantageously constituted by a woven fabric or mat of glass fibers and of a thermoplastics material.

Each of the grids of reinforcing slats 120 and 140 is advantageously made of a reinforced thermoplastic composite of glass fibers and of a thermoplastics material such as a depolymerizable and repolymerizable thermoplastic polymer resin such as polyurethane. The slats may be solid or hollow elongated profiles using pultrusion techniques as described in U.S. Pat. No. 5,891,560. Such technology is generally known as Fulcrum® thermoplastic composite technology wherein Fulcrum® is a trademark of the Dow Chemical Co. of Midland, Mich.

Adding grids of reinforcing slats to the stack automatically leads to increased weight of the resulting deck 106 and, consequently, of the pallet assembly 108. In order to limit this increase in weight, it is important that the adding of the reinforcing slats to the grids be well controlled, and that only the bare minimum be added.

The additional weight of the reinforcing slats may be compensated by reducing the weight per unit area of glass fibers in the skins 110 and 150 used: by combining the weight per unit area of glass fibers in the skins 110 and 150 with the characteristics of the reinforcing slats, it is possible to obtain a deck of weight equivalent to the weight of a deck that does not use reinforcing slats, while offering strength that is more suited to its load requirement.

Thus, the skins 110 and 150 are typically of glass fiber weight per unit area that is different from that of the reinforcing slats 120 and 140.

Advantageously in this example, the cellular core 130 is an open-celled structure of the type made up of tubes or of a honeycomb, and it is made mainly of polyolefin and preferably of polypropylene.

In a second step of the method of making the pallet assembly 108, the stack of layers (but not the feet 120) is pre-assembled. Then, the pre-assembled stack is heated in an oven.

The pre-assembled stack is heated such that the skins 110 and 150 of the stack have a forming temperature approximately in the range of 160° C. to 200° C. The temperatures to which the pre-assembled stack is heated are higher than the degradation temperature of the polypropylene constituting the matrices of the skins 110 and 150, as well as the matrices of the reinforcing slats and of the cellular core 130, but that does not degrade the mechanical characteristics of the resulting deck 106.

The temperature to which the pre-assembled stack is heated in the method of making the deck 106 lies in a range extending from a low temperature enabling the skins 110 and 150 to be bonded to the cellular core 130, in a time compatible with mass production constraints, without the cellular core 130 of the stack being weakened accordingly, to a maximum temperature while avoiding degrading the polypropylene too rapidly.

In the method of making the deck 106, it is possible to add the reinforcing slats to the stack that is to be thermoformed to make the deck 106 because the method offers a heating capability that is sufficient to bond the skins 110 and 150 which are of different thicknesses (due to the added reinforcements).

The quantity of heat transmitted through the skins 110 and 150 and the cellular core 130 is inversely proportional to the thickness of the skins 110 and 150, for identical types of reinforcement.

For a given pre-assembled stack temperature and a given pre-assembled stack-heating time, it is possible to bond a skin of given thickness. If the skin is too thin, it reaches a temperature such that it is degraded. If the skin is too thick, the heat does not arrive in sufficient quantity to enable the skin and the core to be bonded together.

For example, in order to bond a skin made of a 4×1 woven fabric of weight per unit area of 915 g/m$^2$ to a cellular core, provision is made for the heating time to lie in the range 55 seconds to 75 seconds. By using an identical skin of weight per unit area of 1,420 g/m$^2$, a heating time lying in the range 70 seconds to 85 seconds is necessary to bond the skin to the cellular core without degrading it. Similarly, it has been determined that, for an identical skin having a weight per unit area of 710 g/m$^2$, a heating time lying in the range 55 seconds to 65 seconds is necessary to bond it to the cellular core without degrading it.

In a last step of the method of making the deck 106, after the pre-assembled stack has been heated in an oven, the deck 106 is formed by subjecting the heated stack to cold-pressing in a mold under a pressure lying in the range $1\times10^6$ Pa to $3\times10^6$ Pa.

The method of making the deck 106 comprises a small number of operations that are simple and quick to perform. It uses standard equipment (oven, press) for performing the above-mentioned operations which are controlled very well, and therefore entirely suitable for being implemented in the field of the pallet industry, in which the parts are formed at high production throughputs, while also guaranteeing constant quality and economic competitiveness.

The decks made by performing the method of the invention offer strength that is optimized locally, without suffering from any extra weight compared with decks not including any reinforcing slats, or from any extra manufacturing costs.

One of the advantageous applications of such decks whose structure is reinforced by reinforcing slats is to making pallet assemblies and, in particular, the pallet assemblies having attachment and support structures molded to the tine-engaging skin 110 of the deck 106. For example, the resulting deck 106 can be placed in a mold and the support structures 170 can be molded thereto. Also, attachment structures can be molded for securing bolts and the like thereto to secure loads on the deck 106 of the assembly 108. Alternatively, thermoplastic feet may be adhesively attached at the lower surface of the tine-engaging skin 110.

Figure 4:
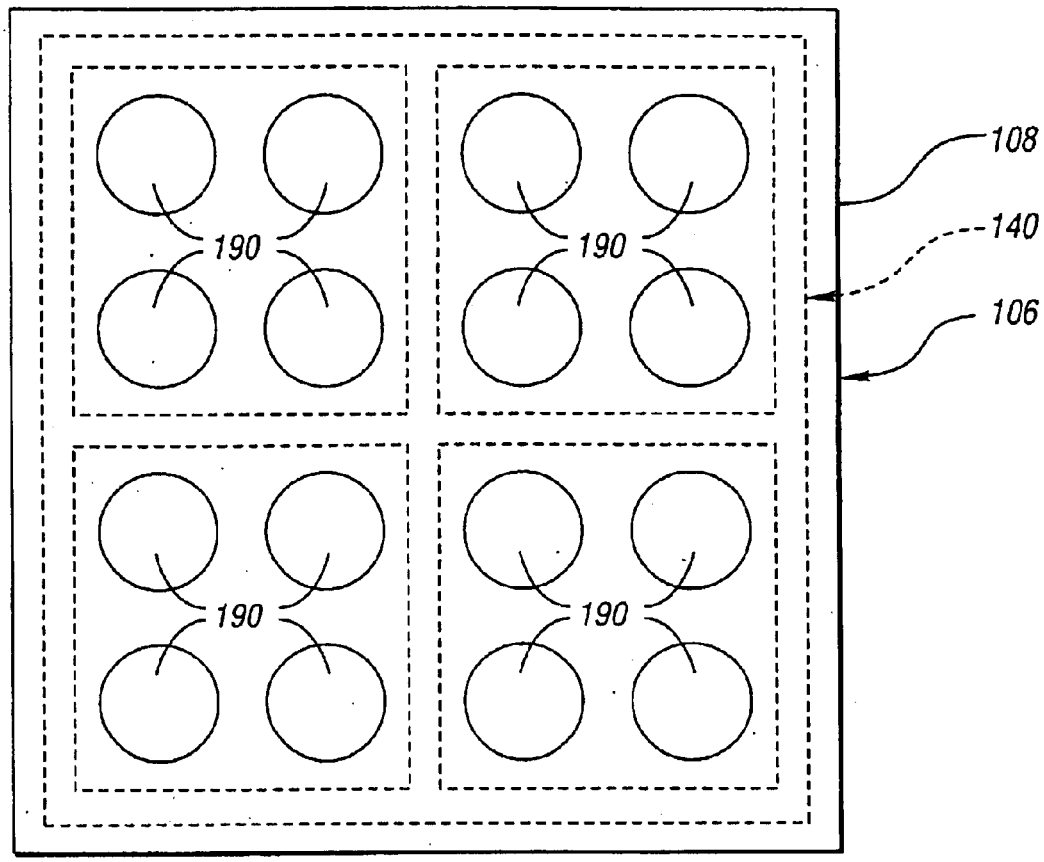
FIG. 4 is a top plan view of a pallet of the present invention after the stack of layers of FIG. 3 are processed in a pressing stage and apertures are punched through the deck with a grid of reinforcing slats illustrated by phantom lines.

Referring now to FIG. 4, holes 190 are preferably punched through the assembly 108 wherein the holes 190 are sized to receive and retain the lower portions 32 of the meters 12.

Figure 5:
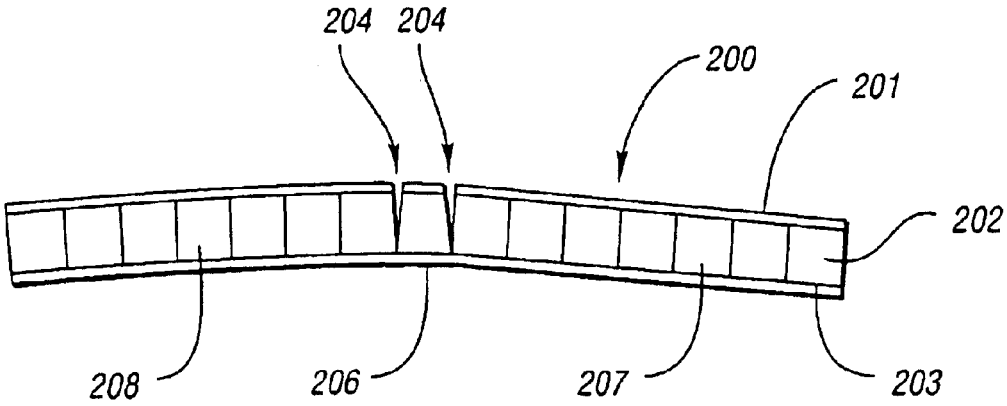
FIG. 5 is a side schematic view of a sandwich-structure composite carrier provided with a hinge.

FIG. 5 shows a panel 200 of sandwich-type composite structure made up of a stack comprising a first skin 201 made of a reinforced thermoplastics material, a cellular core 202, and a second skin 203 made of a reinforced thermoplastics material.

The first and second skins 201, 203 are reinforced with fibers, e.g., glass fibers, carbon fibers or natural fibers.

The first and second skins 202, 203 may advantageously be made up of woven glass fiber fabric and of a thermoplastics material.

The thermoplastics material is a polyolefin and preferably polypropylene.

In this example, the cellular core 202 is an open-celled structure of the type made up of tubes or of a honeycomb, and it is made mainly of polyolefin and preferably polypropylene. Naturally, it is possible to use a cellular structure having closed cells of the foam type.

One side or both sides of the panel 200 may be covered with an outer covering (not shown) made of a woven or non-woven material (of the carpet type).

In the method of making such a panel, the panel 200 is formed by pressing a stack in a cold-forming mold, the stack being made up of the first skin 201, of the cellular core 202, and of the second skin 203, and being pressed at a pressure lying in the range of $10\times10^5$ Pa to $30\times10^5$ Pa.

The first and second skins 201, 203 are preheated to make them malleable.

Advantageously, in order to soften the first and second skins, heat is applied to a pre-assembly constituted by the stack made up of at least the first skin 201, of the cellular core 202, and of the second skin 203 so that, while said panel is being formed, the first and second skins have a forming temperature lying approximately in the range of 160° C. to 200° C., and, in this example, about 180° C.

As shown in FIG. 5, the panel 200 is provided with a pair of incisions 204 at determined places that, in this example, are substantially central to form a hinge for a carrier such as the carrier 14.

Each incision 204 is made after the panel 200 has been formed, and more particularly in the range of 10 to 30 seconds after it has been formed, so as to cut through the first skin 201 and through substantially the entire thickness of the cellular core 202, while the second skin 203 is left intact so that, at the determined places, it forms a hinge 206 between two portions 207, 208 of the incised panel.

One or more serrated blades may advantageously be used to make the incisions 204. The size of the serrations and the height of the blade are functions of the thickness of the sandwich material to be cut.

The serrated blades are mounted to move relative to the plane of said panel 200 as formed, the blade moving vertically initially to cut through the fibers of the top first skin 201 without crushing the sandwich material at this place, and them moving vertically and horizontally back-and-forth relative to the plane of said panel so as to cut through the entire thickness of the cellular core.

The time interval of in the range 10 seconds to 30 seconds between the panel-forming operation and the panel-incision operation enables the thermoformed panel to cool sufficiently for the serrated blades to cut the fibers of said skin properly without crushing the sandwich material.

It is possible to make provision for the incision made in the panel 200 by means of the blade to be effected inside the forming mold or outside the forming mold. When the operation is performed inside the forming mold, the serrated blades are mounted on a moving portion of a portion of the mold that, after the panel has been formed, is displaced relative to the mold so as to effect the panel incision operation.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An assembly for enclosing and protecting a plurality of meters for storage or transportation purposes, the assembly comprising:

a plurality of carriers, each of the carriers including a base unit having upper and lower surfaces for receiving and retaining a plurality of meters in a predetermined spaced relationship thereon and a cover unit and a connector that connects the cover unit to the base unit for movement between a closed position for enclosing, protecting and immobilizing the meters within the base unit and an open position to allow storage or retrieval of one or more meters to or from the base unit, respectively; and a pallet having a load-bearing, upper surface and a tine-engaging, lower surface and an array of apertures extending between the load-bearing, upper surface and tine-engaging, lower surface for receiving and retaining lower portions of the meters in the predetermined spaced relationship thereon when the carriers are supported on the load-bearing, upper surface of the pallet.

2. The assembly as claimed in claim 1 wherein the base unit is a composite base unit of the sandwich-type having a cellular core.

3. The assembly as claimed in claim 2 wherein the cover unit is a composite cover unit of the sandwich-type having a cellular core and wherein the base and cover units have a common skin of reinforced thermoplastics material.

4. The assembly as claimed in claim 3 wherein the connector includes a hinge for hingedly connecting the cover unit to the base unit wherein a portion of the common skin forms the hinge.

5. The assembly as claimed in claim 1 wherein the base unit includes an array of holes extending between the upper and lower surfaces of the base unit and wherein the meters are received and retained within the holes so that lower portions of the meters are suspended below the lower surface of the base unit.

6. The assembly as claimed in claim 5 wherein the array of holes and the array of apertures are aligned when the carriers are supported on the load-bearing, upper surface of the pallet.

7. The assembly as claimed in claim 1 wherein the pallet is of the sandwich-type having a cellular core.

8. The assembly as claimed in claim 1 further comprising a plurality of spaced, holding devices extending upwardly from the load-bearing, upper surface for holding the plurality of carriers on the load-bearing, upper surface.

9. The assembly as claimed in claim 1 wherein the meters are utility meters.

10. The assembly as claimed in claim 9 wherein the utility meters are electric utility meters.

11. A carrier for carrying a plurality of meters therein, the carrier comprising:

a base unit having upper and lower surfaces for receiving and retaining a plurality of meters in a predetermined spaced relationship thereon;

a cover unit and a connector that connects the cover unit to the base unit for movement between a closed position for enclosing, protecting and immobilizing the meters within the base unit and an open position to allow storage or retrieval of one or more meters to or from the base unit, respectively; and a mechanism for alternatively fastening or unfastening the cover unit to or from the base unit, respectively.

12. The carrier as claimed in claim 11 wherein the base unit is a composite base unit of the sandwich-type having a cellular core.

13. The carrier as claimed in claim 12 wherein the cover unit is a composite cover unit of the sandwich-type having a cellular core and wherein the base and cover units have a common skin of reinforced thermoplastics material.

14. The carrier as claimed in claim 13 wherein the connector includes a hinge for hingedly connecting the cover unit to the base unit wherein a portion of the common skin forms the hinge.

15. The carrier as claimed in claim 11 wherein one of the base unit and the cover unit provides an integrally-formed carrying handle.

16. The carrier as claimed in claim 11 wherein the base unit includes an array of holes extending between the upper and lower surfaces wherein the meters are received and retained within the holes so that lower portions of the meters are suspended below the lower surface of the base unit.

17. A pallet of the sandwich-type having a cellular core, the pallet comprising:

a substantially flat deck having upper and lower surfaces and front, back and side edges and including:

a load-bearing skin made of reinforced thermoplastics material;

at least one grid of reinforcing slats;

a cellular core made of a thermoplastics material; and a tine-engaging skin made of a reinforced thermoplastics material; the at least one grid of reinforcing slats being positioned at predetermined places against at least one skin; and at least one support for supporting the deck so that tines can lift and support the pallet at the tine-engaging skin wherein the deck further includes an array of apertures extending between the upper and lower surfaces and configured to receive and retain lower portions of the meters in a predetermined spaced relationship therein.

18. The pallet as claimed in claim 17 further comprising a plurality of spaced, holding devices extending upwardly from the upper surface of the deck for holding a plurality of meter-carrying carriers supported on the upper surface of the deck.

19. The pallet as claimed in claim 17 wherein the pallet is nestable.

20. The pallet as claimed in claim 17 wherein the deck includes upper and lower grids of reinforcing slats positioned symmetrically with respect to a plane formed by the cellular core at predetermined places against the skins and the cellular core.

* * * * *